US006704423B2

(12) United States Patent
Anderson et al.

(10) Patent No.: US 6,704,423 B2
(45) Date of Patent: Mar. 9, 2004

(54) HEARING AID ASSEMBLY HAVING EXTERNAL DIRECTIONAL MICROPHONE

(75) Inventors: C. Roger Anderson, Wilmette, IL (US); John S. French, Arlington Heights, IL (US); Robert B. Schulein, Evanston, IL (US)

(73) Assignee: Etymotic Research, Inc., Elk Grove Village, IL (US)

( * ) Notice: Subject to any disclaimer, the term of this patent is extended or adjusted under 35 U.S.C. 154(b) by 0 days.

(21) Appl. No.: 09/742,252

(22) Filed: Dec. 20, 2000

(65) Prior Publication Data

US 2001/0031058 A1 Oct. 18, 2001

Related U.S. Application Data

(60) Provisional application No. 60/173,427, filed on Dec. 29, 1999.

(51) Int. Cl.[7] ..... H04R 25/00

(52) U.S. Cl. ..... 381/313; 381/356

(58) Field of Search ..... 381/312–313, 381/322, 328–330, 355–357, 380–381, 324, 358, FOR 127, FOR 128, FOR 133, FOR 134, FOR 135, FOR 141, FOR 142, 179–181; 181/129–130, 135

(56) References Cited

U.S. PATENT DOCUMENTS

| | | | | | |
|---|---|---|---|---|---|
| 607,994 | A | * | 7/1898 | Howell | 381/180 |
| 2,262,146 | A | | 11/1941 | Massa | 181/0.5 |
| 2,616,985 | A | * | 9/1950 | Levy | 381/322 |
| 4,291,203 | A | | 9/1981 | Bellafiore | 179/107 |
| 4,456,795 | A | | 6/1984 | Saito | 179/107 |
| 4,489,442 | A | * | 12/1984 | Anderson et al. | 381/356 |
| 4,539,440 | A | * | 9/1985 | Sciarra | 381/329 |
| 5,046,580 | A | | 9/1991 | Barton | 181/135 |
| 5,048,090 | A | * | 9/1991 | Geers | 381/328 |
| 5,208,867 | A | * | 5/1993 | Stites, III | 381/361 |
| 5,226,076 | A | * | 7/1993 | Baumhauer, Jr. et al. | 381/356 |
| 5,381,484 | A | * | 1/1995 | Claes et al. | 381/329 |
| 5,606,621 | A | | 2/1997 | Reiter et al. | 381/686.6 |
| 5,703,957 | A | | 12/1997 | McAteer | 381/92 |
| 5,828,757 | A | | 10/1998 | Michalsen et al. | 381/68.6 |
| 5,835,606 | A | * | 11/1998 | Marie et al. | 381/328 |
| 5,875,254 | A | | 2/1999 | Hanright | |
| 6,009,183 | A | | 12/1999 | Taenzer et al. | 381/330 |
| 6,134,334 | A | * | 10/2000 | Killion et al. | 381/356 |
| 6,151,399 | A | * | 11/2000 | Killion et al. | 381/313 |
| 6,285,771 | B1 | * | 9/2001 | Killion et al. | 381/313 |
| 6,292,572 | B1 | * | 9/2001 | Yoest et al. | 381/322 |
| 6,473,513 | B1 | * | 10/2002 | Shennib et al. | 381/328 |

FOREIGN PATENT DOCUMENTS

| | | | | | |
|---|---|---|---|---|---|
| JP | 57106299 | A | * | 7/1982 | 381/FOR 127 |
| JP | 04245800 | A | * | 9/1992 | 381/FOR 127 |

* cited by examiner

*Primary Examiner*—Curtis Kuntz
*Assistant Examiner*—P. Dabney
(74) *Attorney, Agent, or Firm*—McAndrews, Held & Malloy, Ltd.

(57) ABSTRACT

A hearing aid assembly having a directional microphone mounted externally to a hearing aid body is disclosed. The hearing aid, which may be, for example, an in-the-canal (ITC) or completely-in-the-canal (CIC) hearing aid, has a mounting arm attached to an external surface of the hearing aid body, and the mounting arm in turn has a directional microphone mounted therewith. The mounting arm provides mechanical and electrical connection between the directional microphone and the hearing aid. The mounting arm is also configured such that, upon insertion of the ITC or CIC hearing aid into the ear canal of a wearer, the microphone is located in the region above the tragion portion of the ear.

36 Claims, 6 Drawing Sheets

500

630

800

1000

1250

1600

2000

2500

3150

4000

5000

6300

8000

10000
OPEN TUBE
AIPA 5.33
0
90
-20
-10
0

500

630

800

1000

1250

1600

2000

2500

3150

4000

5000

6300

8000

10000
"STUFFED" TUBE
AIPA 5.99
R = 1200 Ω
0
90
-20
-10
0

HEARING AID ASSEMBLY HAVING EXTERNAL DIRECTIONAL MICROPHONE

CROSS-REFERENCE TO RELATED APPLICATIONS

This application makes reference to, and claims priority to, United States provisional application Ser. No. 60/173,427 filed Dec. 29, 1999.

INCORPORATION BY REFERENCE

The above-referenced United States provisional application Ser. No. 60/173,427 is hereby incorporated herein by reference in its entirety.

STATEMENT REGARDING FEDERALLY SPONSORED RESEARCH OR DEVELOPMENT

N/A

BACKGROUND OF THE INVENTION

Numerous types of hearing aids are known and are currently in use. Hearing aid users generally prefer hearing aid types that are minimally visible to third parties, but provide maximum performance in noisy environments. One common hearing aid type is worn behind-the-ear (BTE) and is quite visible to third parties. Such BTE hearing aids also generally do not perform well in noisy environments. For example, typical BTE hearing aids demonstrate Articulation-Index-weighted average Directivity Index (AIDI) values in the range of 2–3 dB (due to the high frequency shadowing of the Pinna, or earflap). For many users, BTE hearing aids simply do not provide the directivity performance sufficient to make the BTE viable in noisy environments.

In-the-ear (ITE) hearing aid solutions that are less visible and also provide improved performance in noisy environments have therefore been developed using directional microphone technology. One directional microphone for ITE applications is the D-MIC® of Etymoic Research, Inc. The D-MIC® directional microphone in an ITE hearing aid provides typical AIDI values in the range of 5+dB, a substantial improvement over BTE applications.

Despite the fact, however, that ITE hearing aids as such are less visible and provide substantial improvement in directivity performance, ITE hearing aids still require that the entire concha of the wearer's ear be filled, and that the directional microphone be located on the near flat outer surface of the hearing aid. Such an arrangement is still quite visible.

Consequently, even less visible hearing aids have been developed for in the ear applications, namely in the canal (ITC) and completely in the canal (CIC) hearing aids. ITC and CIC hearing aids are discreetly located in the resonant portion of the ear canal, and thus do not require that the entire concha of the ear be filled. Hearing aid wearers, therefore, generally prefer the less visible ITC and CIC hearing aids over ITE hearing aids.

ITC and CIC hearing aids, however, do not perform as well as ITE hearing aids, or even BTE hearing aids, in noisy environments. Directional microphones simply do not provide useful directionality in ITC and CIC hearing aid applications because of the location of the hearing aid in the resonant portion of the wearer's ear canal. The sound field at such a location has no detectable frequency dependent phase shift as is found in free space or on a surface in free space (as with an ITE hearing aid). Currently available ITC and CIC hearing aids therefore use only omni-directional microphones, and provide typical AIDI values in the range of −0.5 to 0.2 dB. Such directionality performance is not adequate for most users in noisy environments.

It is thus an object of the invention to provide the improved directionality performance similar to ITE solutions for the less visible ITC and CIC hearing aids.

It is a further object of the invention to provide the improved directionality performance similar to ITE solutions for BTE hearing aids with little or no visual impact or prior art BTE hearing aid designs.

It is still a further object of the invention to provide an overall improved directivity performance for ITE hearing aid applications.

BRIEF SUMMARY OF THE INVENTION

These and other objects of the invention are achieved in a microphone system having a hearing aid housing and a directional microphone mounted externally to the hearing aid housing. A link operatively couples the directional microphone to a component, such as, for example, a hearing aid amplifier or speaker, located internally to the hearing aid housing. The link may also be configured to mechanically mount the directional microphone to an external surface of the hearing aid housing, which surface may be, for example, a hearing aid faceplate.

In one embodiment, the link is a mounting arm that effectively mounts the directional microphone to a hearing aid faceplate and enables electrical connection of the directional microphone to the component within the hearing aid housing. For example, the mounting arm may be a rigid tube that mounts the directional microphone on one and is mounted to a faceplate on the other. Wires connecting the directional microphone to the internal component may therefore travel through the tube and faceplate.

The directional microphone may be configured externally to the hearing aid housing such that, when the hearing aid housing is inserted into the ear of a wearer, the microphone is located between the helix and tragus portions of the ear.

The directional microphone may comprise a directional microphone cartridge having a front inlet tube and a rear inlet tube both operatively coupled to the microphone cartridge. In one embodiment, the front tube is empty. In another embodiment, an acoustical impedance, such as, for example, a plurality of rods are placed longitudinally in the front inlet tube to improve the polar performance of the directional microphone. The rods may be, for example, monofilament fishing line.

These and other advantages and novel features of the present invention, as well as details of an illustrated embodiment thereof, will be more fully understood from the following description and drawings.

DETAILED DESCRIPTION OF THE INVENTION

Figure 1:
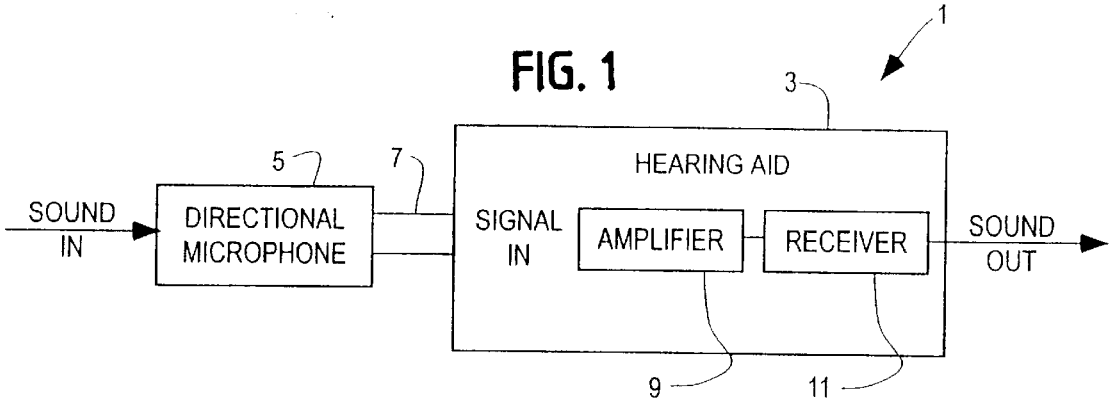
FIG. 1 is a block diagram of a hearing aid assembly of the present invention.

FIG. 1 is a block diagram of a hearing aid assembly of the present invention. Hearing aid assembly 1 comprises a hearing aid 3 that is mechanically and electrically connected to an external directional microphone 5 via a link 7. Directional microphone 5 may be a first or higher order directional microphone. Directional microphone 5 may comprise, for example, a single directional microphone cartridge as shown in FIG. 1 or an array microphone as described in copending application Ser. No. 09/517,848 of Soede et al., which application is incorporated by reference herein in its entirety. Directional microphone 5 may also comprise a dual omni-directional directional microphone. Directional microphone 5 may also incorporate an omni-directional microphone for switching between directional and omni-directional modes. Hearing aid 3 may be a BTE, ITE, ITC or CIC hearing aid, and may include internal components such as an amplifier 9 and a receiver 11, as is known in the art.

During operation of the hearing aid assembly 1, sound energy impinges on the externally located directional microphone 5, and is transduced by the directional microphone 5 into electrical signals. The electrical signals are then transmitted to the hearing aid 3 via the link 7, where the signals are amplified by the amplifier 9, transduced to sound energy by the receiver 11, and then transmitted into the ear canal of a wearer.

Figure 2:
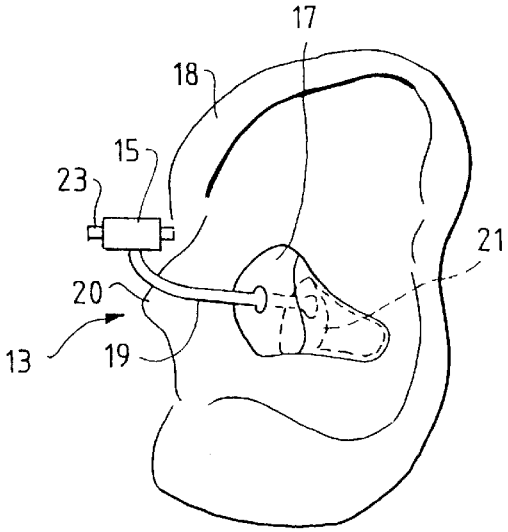
FIG. 2 is one embodiment of the hearing aid assembly of the present invention for ITC and CIC hearing aid applications.

FIG. 2 is one embodiment of the hearing aid assembly of the present invention for ITC and CIC hearing aid applications. Hearing aid assembly 13 comprises a directional microphone 15 that is mechanically and electrically connected to an ITC hearing aid 17 via link (or mounting arm) 19. Alternatively, directionally microphone 15 is mechanically and electrically connected to a CIC hearing aid 21 (shown smaller by a dotted outline) via the links 19. As can be seen, the CIC hearing aid 21, as well as the additional length of the link 19 needed for the location of the CIC hearing aid 21 further in the ear canal (relative to ITC hearing aid 17), are depicted by dashed lines. In either the ITC or CIC application, the directional microphone 15 is located, as generally shown in FIG. 2, in the notch between the helix 18 and tragus 20 portions of the ear, with a front sound inlet port 23 of the microphone 15 facing generally forward.

Figure 3:
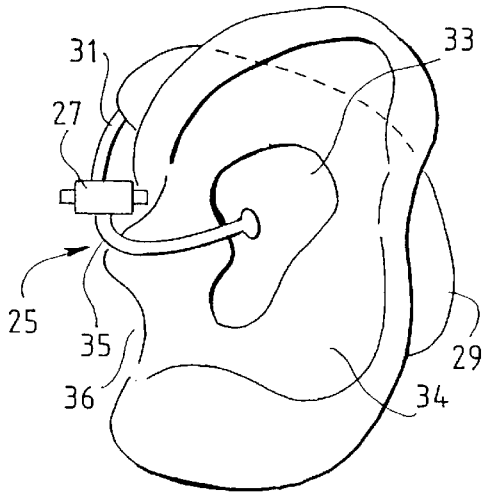
FIG. 3 is another embodiment of the hearing aid assembly of the present invention for BTE hearing aid applications.

FIG. 3 illustrates another embodiment of the hearing aid assembly of the present invention for BTE hearing aid applications. Hearing aid assembly 25 comprises a directional microphone 27 that is electrically and mechanically connected to a BTE hearing aid body 29 via a link (or mounting arm) 31. BTE hearing aid body 29 is also acoustically connected to an earmold 33 via a tube 35. Connection between BTE hearing aid body 29 and tube 35 is not shown in FIG. 3 because the connection is located behind, and is obscured by, directional microphone 27 and link 31. However, connection between BTE hearing aid bodies and earmolds are known in the art.

As can be seen from FIG. 3, the directional microphone 27 is located on the side of the head near the notch between the helix and tragus portions of the ear like the directional microphones in the embodiments illustrated in FIG. 2. Such a location of the directional microphone provides the desired results, as will become more apparent below. However, other locations of the microphone are also possible, such as, for example, in the space 36 below the tragus of the ear. In general, acceptable results may be achieved by, for example, locating the directional microphone with the front sound entry port positioned over the occluded ear canal, and the rear sound entry port positioned approximately in the range of 4–9 millimeters toward the back of the head, in the "bowl" or concha 34 of the ear.

Figure 4:
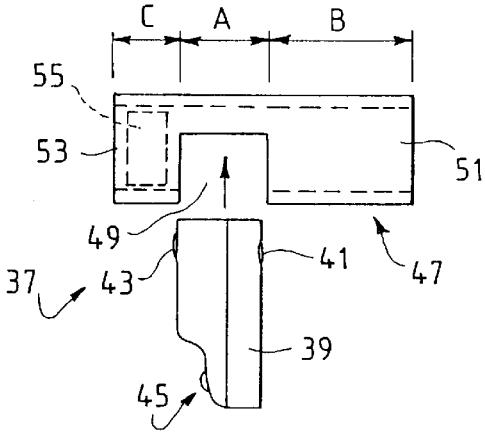
FIG. 4 illustrates an exploded side view of one embodiment of a directional microphone assembly for use in the hearing aid assembly embodiments of FIGS. 2 and 3.

FIG. 4 illustrates an exploded side view of one embodiment of a directional microphone assembly for use in the hearing aid embodiments of FIGS. 2 and 3. Directional microphone assembly 37 comprises a directional microphone cartridge 39 having a front sound inlet port 41, a rear sound inlet port 43 and electrical terminals 45. The directional microphone cartridge may be, for example, a variation of a Model TM directional microphone cartridge available from Knowles Electronics.

Directional microphone assembly 37 further comprises a hollow tube 47. Tube 47 may be, for example, #15 hypodermic tubing having an inner diameter of 0.054 inches, and may have, for example, an overall length of approximately 0.23 inches. Tube 47 has saddle notch 49 cut or formed therein, forming a front sound inlet tube portion 51 on the front end of the tube 47, and a rear sound inlet tube portion 53 on the rear end of tube 47. Saddle notch 49 may be, for example, 0.070 inches long (see dimension A in FIG. 4), front sound inlet tube portion 51 may be, for example, 0.110 inches long (see dimension B in FIG. 4), and rear sound inlet tube portion 53 may be, for example, 0.050 inches long (see dimension C in FIG. 4). While a notch 49 is shown in single tube 47 to form the tube portions 51 and 53 (for ease of assembly), it should be understood that two separate tubes could be attached on either side of microphone cartridge 39 to form front and rear sound inlets.

During assembly of the microphone assembly 37, the microphone cartridge 39 is placed in the saddle notch 49 so that the front sound inlet port 41 communicates with the front sound inlet tube portion 51 of the tube 47, and the rear sound inlet port 43 communicates with the rear sound inlet tube portion 53 of the tube 47. Rear sound inlet tube portion 53 may also have an acoustic resistor 55 placed therein for determining, for example, the polar pattern of the directional microphone assembly 37. Epoxy may also be used on surface(s) in the saddle notch 49 to seal around edges of tube portions 51 and 53 that mate with microphone cartridge 39, to solidify the microphone assembly 37.

Figure 5:
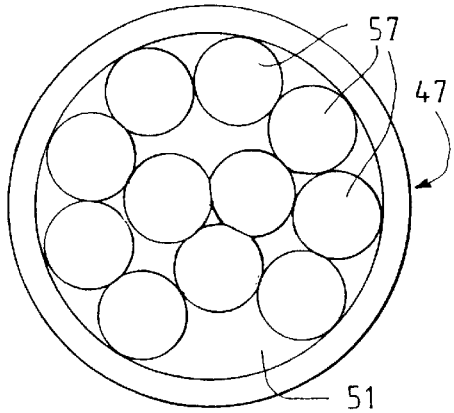
FIG. 5 is an end view of the front tube portion of the microphone assembly of FIG. 4 having rods placed longitudinally in the front tube portion.

In the embodiment of FIG. 4, front sound inlet tube portion 51 of the tube 47 is shown as an open tube. In an alternate embodiment, the microphone assembly of FIG. 4 may be modified by adding an acoustical impedance into the front sound inlet tube portion 51 to reduce its diameter and improve the polar performance of the directional microphone assembly. For example, a single sleeve, plural vinyl tubes, pieces of enameled wire, or rods may be placed in the front tube portion 51. FIG. 5 is an end view of the front tube portion of the microphone assembly of FIG. 4 having 11 rods 57 placed longitudinally in the front tube portion 51. The rods 57 may be, for example, 0.014 inch monofilament fishing line.

Figure 6:
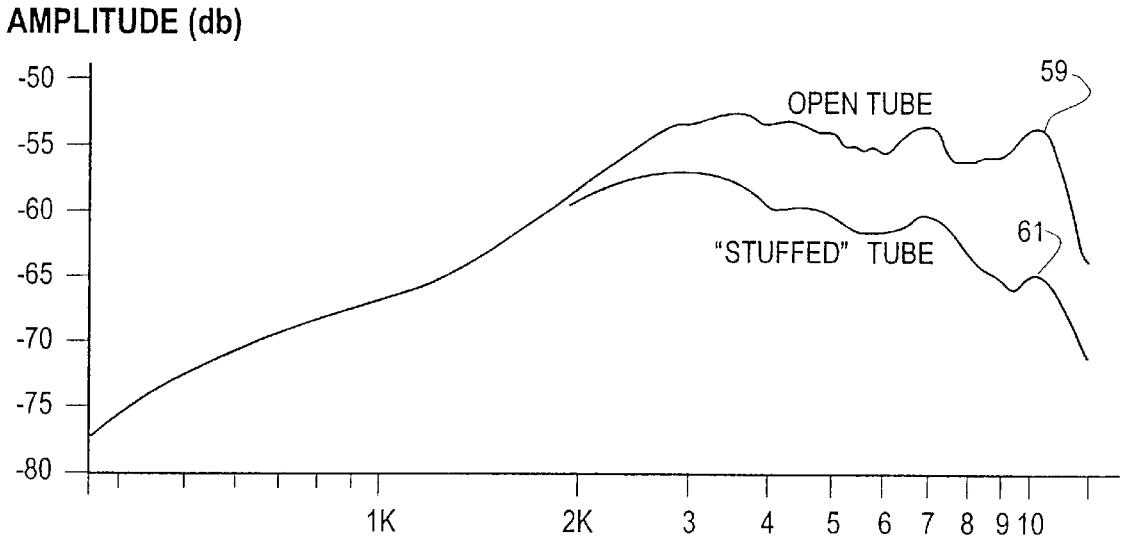
FIG. 6 is a plot of the frequency response for each of the directional microphone assembly embodiments of FIGS. 4 and 5.

FIG. 6 is a plot of the frequency response for each of the embodiments of FIGS. 4 and 5. Curve 59 is the response for the embodiment of FIG. 4 (i.e., having an open front tube portion), and curve 61 is the response for the embodiment of FIG. 5 (i.e., having an acoustic impedance located in the front tube portion). A value of 1200 Ω was used for the acoustic resistor 55 in both embodiments. In the case of curve 61, the 11 rods 57 of FIG. 5 are 0.014 inch monofilament fishing line. As can be seen in FIG. 6, the response curve 61 at 3–4 KHz is lower than response curve 59 by about 5 dB, and at 10 KHz is lower than response curve 59 by about 11 dB. Thus, the peak generated by the open tube arrangement is flattened or is rolled off by the addition of an acoustic impedance. While such a roll-off may not be desirable, the addition of the acoustic impedance improves the polar response of the directional microphone assembly.

Figures 7A, 7B, 7C, 7D, 7E, 7F, 7G, 7H, 7I, 7J, 7K, 7L, 7M, 7N:
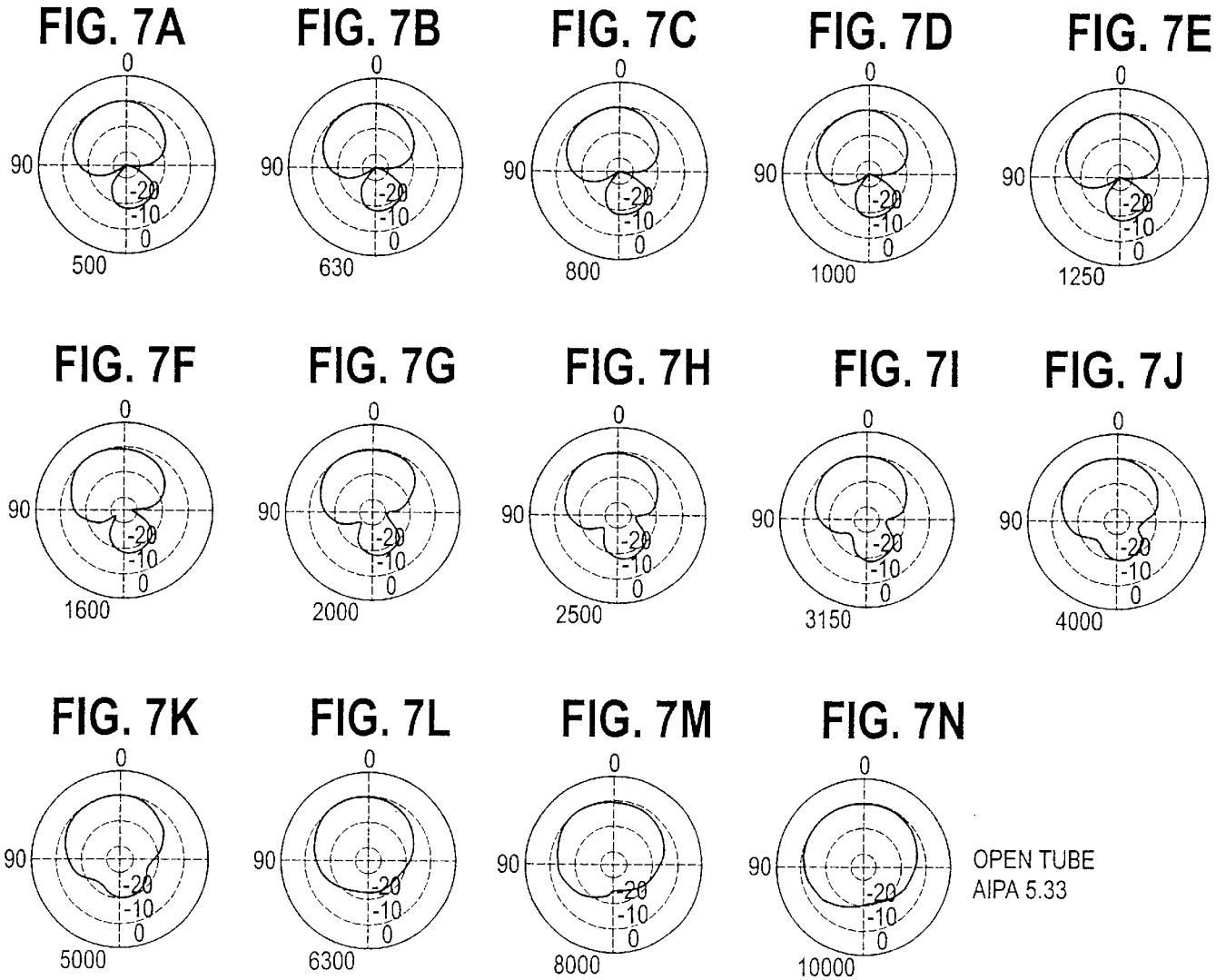
FIG. 7 illustrates plots of the polar response of the directional microphone assembly of FIG. 4.
Figures 8A, 8B, 8C, 8D, 8E, 8F, 8G, 8H, 8I, 8J, 8K, 8L, 8M, 8N:
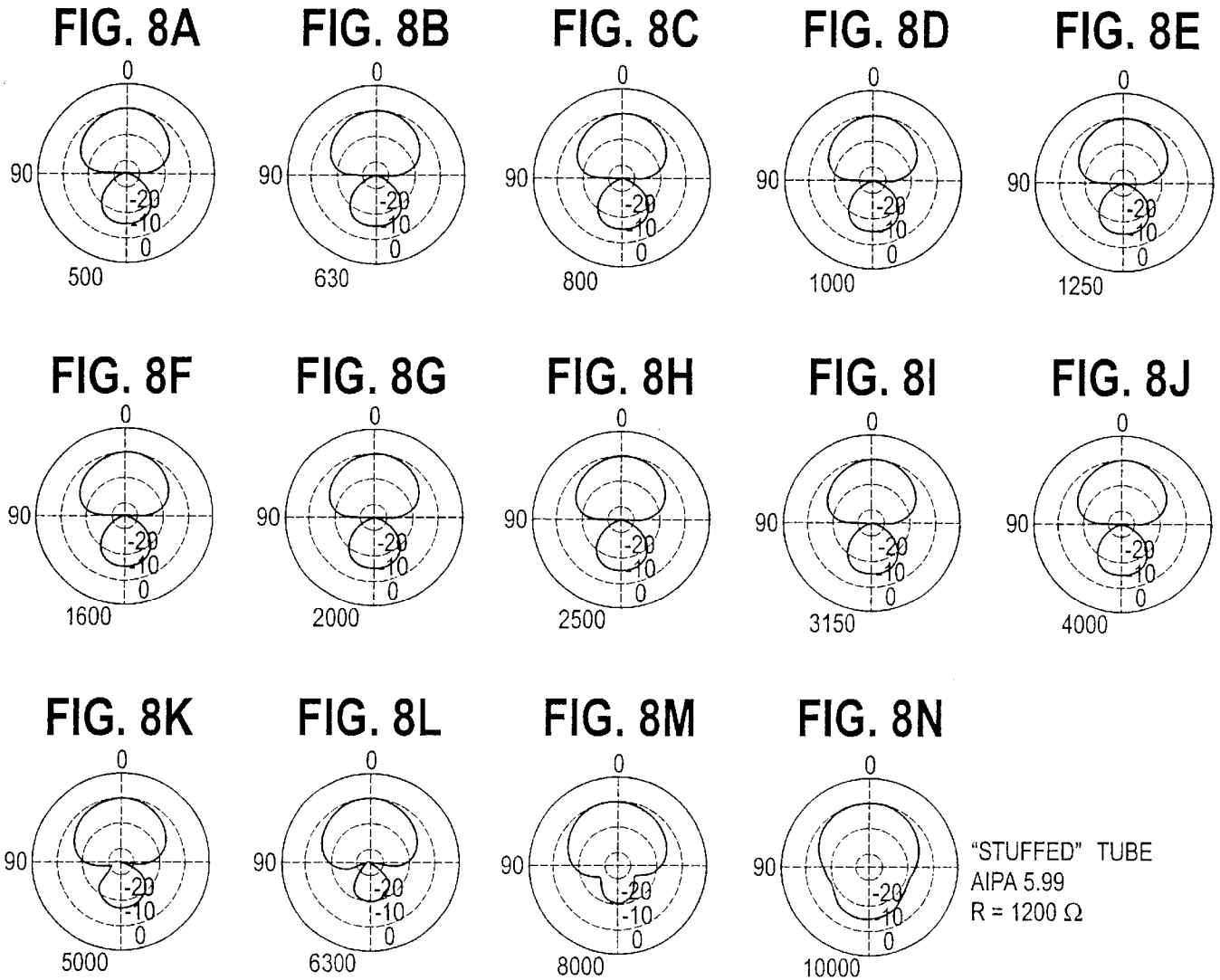
FIG. 8 illustrates plots of the polar response of the directional microphone assembly of FIG. 5.

More specifically, FIG. 7 illustrates plots of the polar response of the directional microphone assembly having an open tube arrangement as in FIG. 4, while FIG. 8 illustrates plots of the polar response of the directional microphone assembly of FIG. 4 having the rods of FIG. 5. Again, a value of 1200 Ω was used for the acoustic resistor 55 in both embodiments. A comparison of FIGS. 7 and 8 shows that the directional microphone assembly having the acoustic impedance maintains its directionality better (longer) as the frequency increases. In addition, the directional microphone assembly having the acoustic impedance has a higher overall AIDI value (5.99 as compared to 5.33). In either embodiment, however, the AIDI values achieved are comparable to those achieved by prior art ITE hearing aids (mentioned above).

Figure 9:
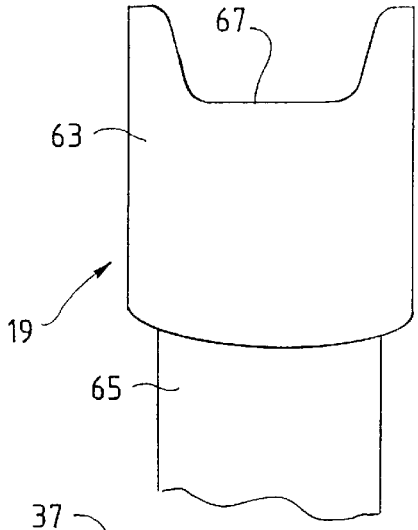
FIG. 9 depicts an upper mounting portion and tube portion of a link or mounting arm according to the present invention.

FIG. 9 depicts an upper mounting portion 63 and a tube portion 65 of the link 19 of FIG. 2 for mounting the directional microphone assembly of FIG. 4. Upper mounting portion 63 may be formed by flattening and shaping a single tube (and thus creating the upper mounting portion 63 and tube portion 65). Upper mounting portion 63 comprises notches 67 that receive the front sound inlet tube portion 51 and the rear sound inlet tube portion 53 of the tube 47 when, upon assembly, the microphone cartridge 39 is seated within the upper mounting portion 63. Tube portion 65 is hollow, so that electrical connection between the microphone cartridge 39 and the hearing aid amplifier can be made by wires running through the link 19.

Figure 10:
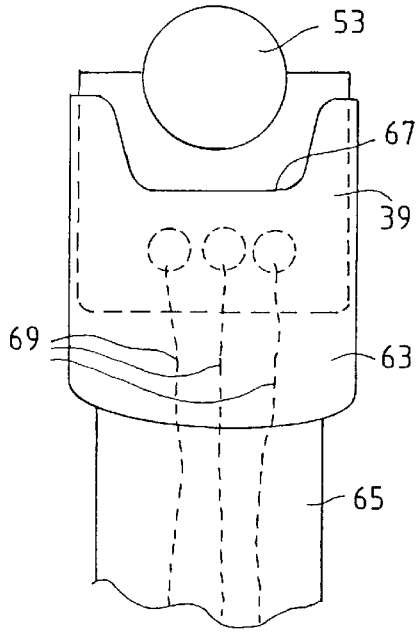
FIG. 10 illustrates the directional microphone assembly of FIG. 4 mounted in the upper mounting portion of FIG. 9.

FIG. 10 illustrates the directional microphone assembly of FIG. 4 mounted in the upper mounting portion 63 (FIG. 9) of the link 19 of FIG. 2. The microphone assembly as depicted in FIG. 4 has been rotated 90 degrees and mounted with the upper mounting portion 63. Microphone cartridge 39 is seated within the upper mounting portion 63, such that rear sound inlet tube portion 53 rests partially within a notch 67. Front sound inlet tube portion 51 (not shown) likewise partially rests within a notch 67 (not shown) on the opposite side of the upper mounting portion 63. Glue may be used to rigidly attach the directional microphone assembly and the upper mounting portion 63. Each of the three electrical terminals 45 on the microphone cartridge 39 is connected to a wire, and the three wires 69 run through the tube portion 65 for electrical connection to the hearing aid amplifier or other hearing aid component(s) (not shown).

Figure 11:
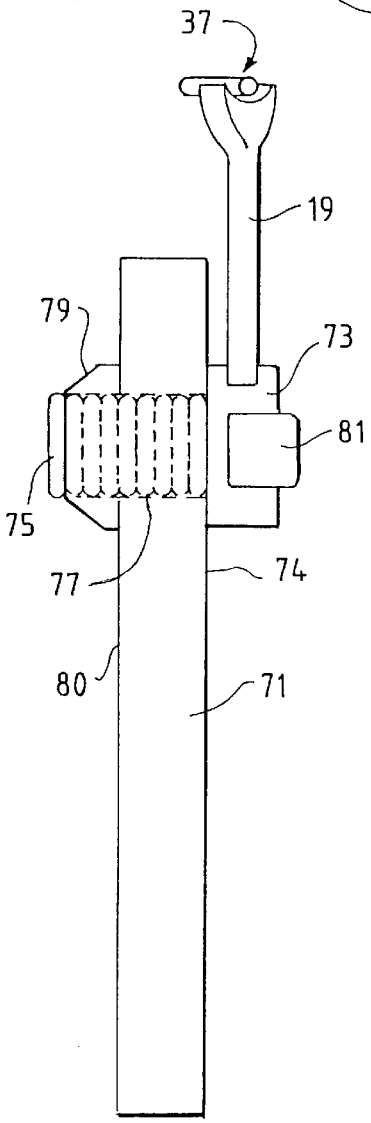
FIG. 11 illustrates a side cross-sectional view of one embodiment of connection of the link or mounting arm of FIG. 2 with a hearing aid faceplate.

FIG. 11. illustrates a side cross-sectional view of one embodiment of connection of the link (or mounting arm) 19 of FIG. 2 with a hearing aid faceplate 71 via an elbow 73. For a right ear hearing aid model with mounting in the notch between the helix and tragus, the elbow 73 is, for example, approximately 90 degrees, and the link 19 is mounted generally parallel with the faceplate 71. In addition, the microphone assembly 37 is mounted, for example, approximately 45 degrees to the faceplate 71.

The link 19 is mounted within an opening in the elbow 73. The length of the link 19 may be adjusted by moving the link 19 further into or out of the opening in the elbow, and the link 19 may then be glued in place. The length of the link 19 may also be adjusted further by bending it once it has been glued in place. The microphone assembly 37 may also be oriented by rotating the link 19 within the opening of the elbow 73 prior to application of the glue.

Elbow 73 is mounted on an outer surface 74 of faceplate 71 and includes a threaded stem 75 that passes through an opening 77 in the faceplate 71. The threaded stem 75 mates with a nut 79. When tightened, the nut 79 rests against an inner surface 80 of the faceplate 71 to firmly mount the elbow 73, and thus the link 19, on the hearing aid faceplate 71. The threaded stem 75 is also hollow to allow the microphone wires to pass from the link 19 to the hearing aid amplifier or other hearing aid component(s) (not shown).

Elbow 73 may also include an omni-directional microphone 81 mounted in a recess in the elbow 73. Wires from the omni-directional microphone 81 can likewise pass through the threaded stem 75 to the hearing aid amplifier or other hearing aid component(s) (not shown). Omni-directional microphone 81 may be, for example, a Model FG microphone from Knowles Electronics.

Figure 12:
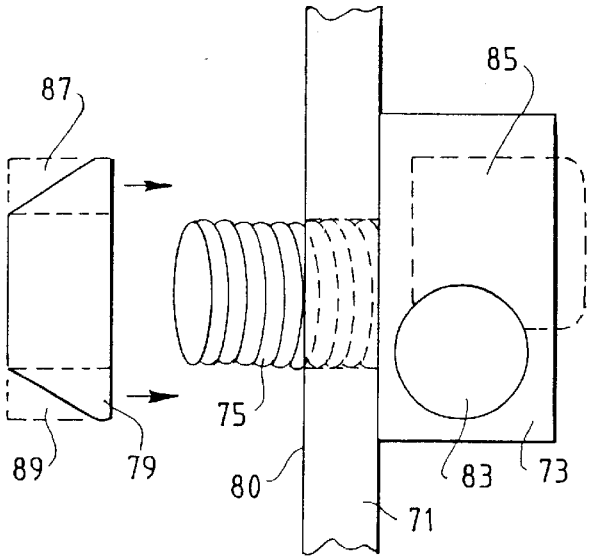
FIG. 12 is a top view of one embodiment of an elbow and nut depicted in FIG. 11.

FIG. 12 is a top view of one embodiment of the elbow 73 and nut 79 of FIG. 11. Elbow 73 includes an opening 83 for receiving the link or mounting arm 19, as well as a recess 85 for receiving the omni-directional microphone 81. Opening 83 may have, for example, a diameter of approximately 0.065 inches. From the location of the opening 83 and the recess 85 in FIG. 12, it appears that an interference may occur between the link 19 and omni-directional microphone 81 when they are respectively placed in the opening 83 and the recess 85. However, this apparent interference may be resolved by notching the end of the link 19 inserted into the opening 83.

As mentioned above, threaded stem 75 is hollow to enable wires to pass therethrough. The threaded stem may have, for example, an outer diameter of approximately 0.087 inches and an inner diameter of approximately 0.038 inches. Such an inner diameter enables 6 wires to fit through the threaded stem 75 (3 from the directional microphone cartridge and 3 from the omni-directional microphone).

Also as mentioned above, the threaded stem 75 mates with a nut 79 which, when tightened, rests against an inner surface 80 of the hearing aid faceplate 71. To conserve space within the hearing aid, the nut 79 may be modified by cutting off portions 87 and 89 of the nut 79.

Figure 13:
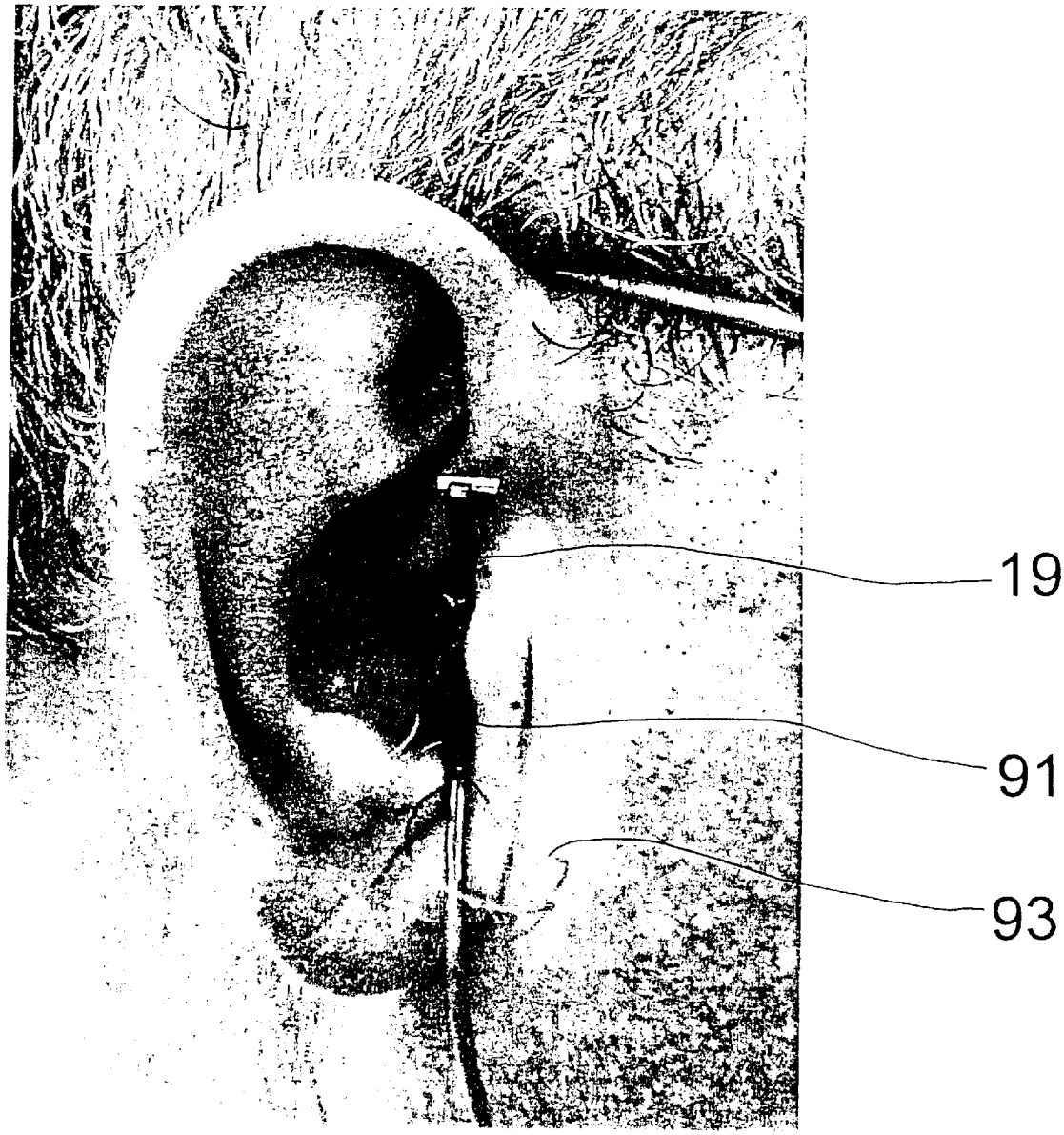
FIG. 13 illustrates one embodiment of the hearing aid assembly of the present invention inserted into the ear canal of a wearer.

FIG. 13 illustrates one embodiment of the hearing aid assembly of the present invention inserted into the ear canal of a wearer. As can be seen, when the hearing aid is seated in the ear canal, the directional microphone is located in the notch between the helix and tragus of the ear. It should be understood that the cable 91 and wire 93 shown in FIG. 13 exist solely for test and hearing aid removal purposes, respectively, and are not a necessary part of the operable device. The mounting arm 19 may instead be used as a lever for insertion and removal of the hearing aid.

Many modifications and variations of the present invention are possible in light of the above teachings. Thus, it is to be understood that, within the scope of the appended claims, the invention may be practiced otherwise than as described hereinabove.

What is claimed and desired to be secured by Letters Patent is:

1. A hearing aid assembly comprising:

a hearing aid housing having at least one internal component;

a mounting arm mounted to an external surface of the hearing aid housing; and a directional microphone mounted on the mounting arm and externally to the hearing aid housing, the directional microphone being located outside the ear canal passage when the hearing aid housing is worn by a user, said mounting arm enabling electrical connection between the external directional microphone and the at least one internal component, the mounting arm being configured such that the directional microphone is located between the helix and tragus portions of the ear and is oriented in a direction that a user is facing, when the hearing aid housing is worn by the user.

2. The hearing aid assembly of claim 1 wherein the external surface of the hearing aid housing comprises a hearing aid faceplate.

3. The hearing aid assembly of claim 1 further comprising an elbow mounted between the mounting ann and the external surface of the hearing aid housing.

4. The hearing aid assembly of claim 3 wherein the elbow is approximately 90 degrees, and the mounting arm is mounted approximately parallel to the external surface of the hearing aid housing.

5. The hearing aid assembly of claim 4 wherein the directional microphone is mounted approximately 45 degrees to the external surface of the hearing aid housing.

6. The hearing aid assembly of claim 1 wherein the directional microphone comprises one of a single directional microphone cartridge, an array microphone or a dual omnidirectional microphone.

7. The hearing aid assembly of claim 6 wherein the directional microphone further comprises front and rear sound inlet tubes operatively coupled to the directional microphone cartridge.

8. The hearing aid assembly of claim 7 wherein the front and rear sound inlet tubes are formed by a single tube having a notch, and wherein at least a portion of the microphone cartridge rests within the notch.

9. The hearing aid assembly of claim 1 wherein the mounting arm includes a mounting portion for receiving and mounting the directional microphone therein.

10. The hearing aid assembly of claim 7 further comprising a plurality of rods mounted longitudinally in the front inlet tube.

11. The hearing aid assembly of claim 10 wherein the plurality of rods are comprised of monofilament fishing line.

12. The hearing aid assembly of claim 1 wherein the directional microphone comprises one of a first order or a higher order directional microphone.

13. A hearing aid system comprising:

a hearing aid housing having at least one internal component;

a directional microphone mounted externally to the hearing aid housing, the directional microphone being located outside the ear canal passage and between the helix and tragus portions of the ear and is oriented in a direction that a user is facing, when the hearing aid housing is worn by the user, the directional microphone being supported without requiring a mounting assembly coupled to an external portion of the car; and a link operatively coupling the directional microphone to the at least one internal component.

14. The hearing aid assembly of claim 13 wherein the directional microphone comprises one of a single directional microphone cartridge, an array-microphone or a dual omnidirectional microphone.

15. The hearing aid system of claim 14 wherein the directional microphone further comprises front and rear inlet tubes operatively coupled to the directional microphone cartridge.

16. The hearing aid system of claim 13 wherein the link is configured to mechanically mount the directional microphone to an external surface of the hearing aid housing.

17. The hearing aid system of claim 13 wherein the link comprises a mounting arm.

18. The hearing aid system of claim 17 wherein the mounting arm mounts the directional microphone to an external surface of the hearing aid housing.

19. The hearing aid system of claim 18 wherein the external surface of the hearing aid hocusing comprises a hearing aid faceplate.

20. The hearing aid assembly of claim 13 wherein the directional microphone comprises one of a first order or a higher order directional microphone.

21. A hearing aid system comprising:

a directional microphone cartridge;

a front inlet tube operatively coupled to the directional microphone cartridge; and a plurality of non-hollow rods mounted longitudinally in the front inlet tube; said directional microphone cartridge being located outside the ear canal passage and between the helix and tragus portions of the ear and is oriented in a direction that a user is facing, when the hearing aid housing is worn by the user.

22. The hearing aid system of claim 21 wherein the plurality of rods are comprised of monofilament fishing line.

23. The hearing aid system of claim 21 further comprising a hearing aid housing, and wherein the directional microphone cartridge and front inlet tube are mounted externally to the hearing aid housing.

24. A hearing aid system comprising:

a hearing aid housing having at least one internal component;

a directional microphone mounted externally to the hearing aid housing; an earmold;

a first link operatively coupling the directional microphone to the at least one internal component; and a second link for acoustically coupling the directional microphone to the earmold; said directional microphone being located outside the ear canal passage and between the helix and tragus portions of the ear when the hearing aid system is worn by a user.

25. The hearing aid system of claim 24 wherein the directional microphone comprises one of a single directional microphone cartridge, an array microphone or a dual omnidirectional microphone.

26. The hearing aid system of claim 24 wherein the directional microphone comprises one of a first order or a higher order directional microphone.

27. The hearing aid system of claim 24 wherein the first link is configured to mechanically mount the directional microphone to an external surface of the hearing aid housing.

28. The hearing aid system of claim 24 wherein the first link comprises a mounting arm.

29. The hearing aid system of claim 28 wherein the mounting arm mounts the directional microphone to an external surface of the hearing aid housing.

30. The hearing aid system of claim 24 wherein the second link comprises a tube.

31. The hearing aid system of claim 24 wherein the hearing aid housing is configured for mounting behind the ear of a wearer.

32. A hearing aid system comprising:

a hearing aid housing having at least one internal component;

a directional microphone mounted externally to the hearing aid housing, the directional microphone being located outside the ear canal passage and between the helix land the tragus portions of the ear and is oriented in a direction that a user is facing, when the hearing aid housing is worn by the user; and a link operatively coupling the directional microphone to the at least one internal component.

33. A hearing aid system comprising:

a hearing aid housing having at least one internal component;

a directional microphone mounted externally to the hearing aid housing, the directional microphone being located outside the ear canal passage and between the helix and tragus portions of the ear and is oriented in a direction that a user is facing, when the hearing aid housing is worn by the user; and a link operatively coupling the directional microphone to the at least one internal component, wherein the link is configured to mechanically mount the directional microphone to an external surface of the hearing aid housing.

34. A hearing aid system comprising:

a hearing aid housing having at least one internal component;

a directional microphone mounted externally to the hearing aid housing, the directional microphone being located outside the ear canal passage and between the helix and tragus portions of the ear and is oriented in a direction that a user is facing, when the hearing aid housing is worn by the user; and a link operatively coupling the directional microphone to the at least one internal component wherein the link comprises a mounting arm.

35. The hearing aid system of claim 34 wherein the mounting arm mounts the directional microphone to an external surface of the hearing aid housing.

36. The hearing aid system of claim 35 wherein the external surface of the hearing aid housing comprises a hearing aid faceplate.

* * * * *